US005310178A

United States Patent [19]

Walker et al.

[11] Patent Number: 5,310,178

[45] Date of Patent: May 10, 1994

[54] BASKETBALL WITH POLYURETHANE COVER

[75] Inventors: Alan D. Walker, Somers, Conn.; Joseph F. Baltronis, Agawam, Mass.

[73] Assignee: Lisco, Inc., Tampa, Fla.

[21] Appl. No.: 10,956

[22] Filed: Jan. 29, 1993

[51] Int. Cl.[5] ..... A63B 41/02; A63B 41/08

[52] U.S. Cl. ..... 273/65 B; 273/65 EB; 273/65 EG; 273/DIG. 8

[58] Field of Search ..... 273/65 E, 65 EB, 65 EC, 273/65 ED, 65 EG, 58 BA, DIG. 8, 65 B, 65 R, 65 C, 65 D

[56] References Cited

U.S. PATENT DOCUMENTS

| | | | |
|---|---|---|---|
| 2,789,821 | 4/1957 | Crowley | 273/65 EB |
| 3,119,618 | 1/1964 | Molitor et al. | 273/65 E |
| 3,219,347 | 11/1965 | Way | 273/65 EB |
| 3,256,019 | 6/1966 | Barton | 273/65 EB |
| 4,093,219 | 6/1978 | Piraud | 273/65 B |
| 4,333,648 | 6/1982 | Aoyama | 273/65 EB |
| 4,462,590 | 7/1984 | Mitchell | 273/65 E |

*Primary Examiner*—George J. Marlo

[57] ABSTRACT

An improved basketball comprising an interior spherical bladder formed principally of synthetic butyl rubber with a thickness of about 0.82 millimeters; an intermediate layer of monofilament strands formed of nylon and wound around the bladder to a thickness of between about 0.3 and 0.7 millimeters; an exterior carcass of molded natural rubber formed of two hemispheres with exteriorly projecting ribs or channels; and a plurality of polyurethane inserts formed with matted fibers of nylon or a polyester with a diameter of about 1 micron adhered to the exterior surface of carcass between the channels, the inserts having a thickness of about 1.8 millimeters.

7 Claims, 5 Drawing Sheets

BASKETBALL WITH POLYURETHANE COVER

BACKGROUND OF THE INVENTION

1. Field of the Invention

This invention relates to a basketball with a polyurethane cover and, more particularly, to an improved basketball with an interior balloon-like spherical bladder, an intermediate layer formed of spiral wound strands, an exterior shell formed of two hemispherically shaped carcass members with exterior channels, and polyurethane inserts adhered to the exterior member between the channels.

2. Description of the Background Art

Significant advances have been made in connection with basketballs to improve their overall playability by providing high rebound capabilities, improved wear characteristics and superior feel during handling. The basketballs with the greatest combinations of such desirable properties are those covered with exterior panels of high quality leather. Such leather basketballs are traditionally used during indoor play by the National Basketball Association and other professional leagues as well as the NCAA, high schools, etc. Inferior play is provided where the inserts are fabricated of high quality synthetic materials or where cheaper natural materials are utilized. Significantly inferior basketballs, as for out door and recreational use, are made of a variety of other techniques.

Types of cover materials in descending order of playing characteristics are grain leathers, split leather, polyurethane and then polyvinyl chloride. All known synthetic covers, however, have lower rebound characteristics compared to real leather although some of the higher grade synthetics are nearly to the quality of lower grade leathers. None, however, have the overall improved rebound capabilities or wearability or feel of leather.

As evidenced by a large of number of prior art patents to basketballs and their methods of fabrication, efforts are continuing to improve the characteristics of basketballs while maintaining reasonable costs. Note for example U.S. Pat. Nos. 3,119,618 to Molitor; 4,093,219 to Piraud; 4,333,648 to Aoyama and 4,462,590 to Mitchell.

The patent to Molitor relates to a basketball of the type adapted to be gripped and bounced in play and has an inner carcass provided with fibrous reinforcements and a cover therearound. The improvement comprises a cellular sponge layer disposed between the inner carcass and the cover for facilitating depression of the cover.

The patent to Piraud relates to balls for sports which consist of an external wear layer surrounding a bladder which also forms the body of the ball. The exterior layer is made from a powdered or liquid elastomeric resin comprising a polycondensation product of at least one compound of the group consisting of the dicarboxylic acids and esters of the dicarboxylic acids having a molecular weight of less than 300 with a polyalkyleneoxyglycol whose molecular weight is between 400 and 6000, and at least one diol having a molecular weight of less than 250. The external layer, suitably of rubber or leather, is secured directly to the bladder/body by a polyurethane-base adhesive or the like.

The patent to Aoyama relates to an improved inflatable type ball comprising a rubber tube used as a ball substrate which is introduced with gas under pressure.

A reinforcing winding layer is formed by simultaneously winding the combination of a nylon thread and either an elastic rubber of urethane elastomer thread around the outer periphery of the rubber tube. A surface cover layer is made of a natural or synthetic leather stock which covers the reinforcing winding layer therewith through an adhesive with or without interposing and intermediate rubber layer formed by molding and vulcanization on the peripheral surface of the reinforcing winding layer.

Lastly, the patent to Mitchell relates to a padded game ball comprising an inner bladder assembly and an outer carcass enclosing the bladder assembly. The carcass comprises an outer cover of relatively tough durable material, padding on the inside of the cover, and a liner on the inside of the padding. The inner bladder assembly comprises an inflatable bladder of an elastic substantially air-impervious material. A sheath is provided around the bladder for restraining expansion of the bladder when it is inflated thereby to reduce the outward pressure of the carcass and thus increase the dimensional stability of the ball.

None of the known basketballs or background patents discloses a basketball constructed as disclosed herein with an improved polyurethane cover. In addition no prior effort suggests that the combination of component elements arranged and configured as disclosed herein. In addition, no prior synthetic basketball provides the superior characteristics of the present invention.

The present invention achieves its intended purposes, objects and advantages over the prior art through a new, useful and unobvious combination of component elements, through the use of a minimum number of functioning parts, at a reasonable cost to manufacture, and through the utilization of only readily available an conventional materials.

Therefore it is an object of the present invention to provide an improved basketball comprising an interior spherical bladder formed principally of synthetic butyl rubber with a thickness of about 0.82 millimeters; an intermediate layer of monofilament strands formed of a polymeric material such as Nylon, preferably Nylon 66 or Nylon/Polyester mixes and wound around the bladder to a thickness of between about 0.3 and 0.7 millimeters; an exterior carcass of molded natural rubber formed of two hemispheres with exteriorly projecting channels; and a plurality of polyurethane inserts formed with matted fibers of a polymeric material preferably Nylon or a polyester with a diameter of about 1 micron adhered to the exterior surface of carcass between the channels, the inserts having a thickness of about 1.8 millimeters.

It is another object of the present invention to improve the rebounding characteristics of synthetic basketballs.

It is another object of the present invention to improve the wear characteristics of synthetic basketballs.

It is a further object of the present invention to improve the feel or handling characteristics of synthetic basketballs.

Lastly, it is an object of the present invention to maximize the beneficial properties of basketballs while utilizing a less expensive cover of polyurethane rather than the finer grades of leather.

The foregoing has outlined some of the more pertinent objects of the present invention. These objects should be construed to be merely illustrative of some of the more prominent features and application of the intended invention. Many other beneficial results could be obtained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown on the attached drawing. For the purposes of summarizing the invention, the invention may be incorporated into an improved basketball comprising an interior spherical bladder, an intermediate layer of monofilament strands wound around the bladder, an exterior carcass formed of two hemispheres with exteriorly projecting channels, and a plurality of synthetic inserts adhered to the exterior surface of the carcass between the channels, the inserts being fabricated of a mat of fibers and having a mat thickness of between about 0.1 and 2.0 millimeters, and polyurethane covering and encasing the mat to provide a insert thickness of between about 0.1 and 2.5 millimeters.

The bladder is fabricated of about 85% synthetic butyl rubber (SBR) and about 15% natural rubber. The weight of the bladder is between about 140 and 150 grams. The mat fibers are of a polymeric material preferably Nylon or a polyester material about 0.1 and 2.0 millimeters in thickness. The fibers have a diameter of about 1.0 microns.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent methods and structures do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference numerals refer to similar parts throughout the various Figures.

DETAILED DESCRIPTION OF THE PREFERRED EMBODIMENT

Figure 1:
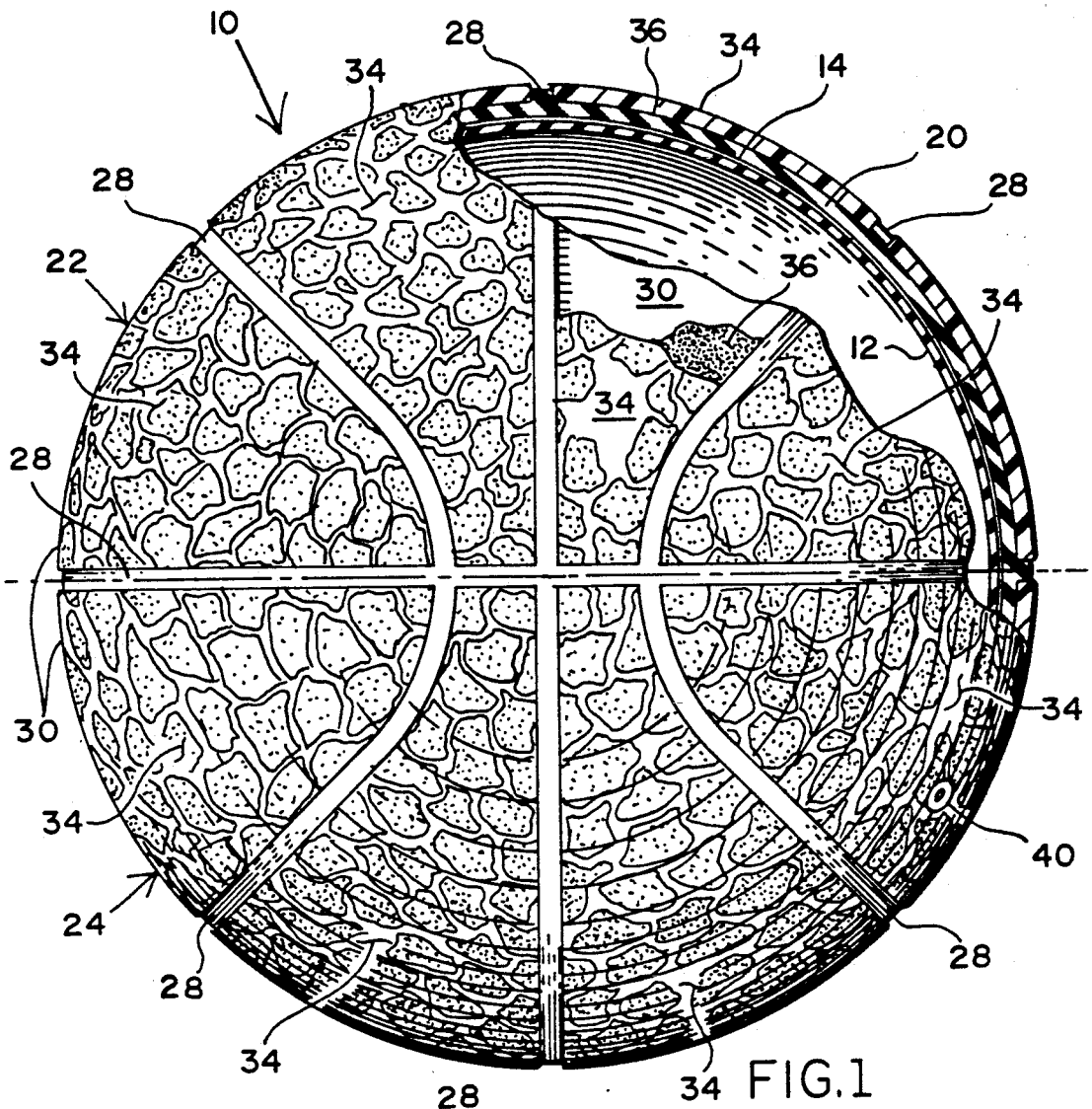
FIG. 1 is an elevational view of a basketball constructed in accordance of the principles of the present invention.
Figure 2:
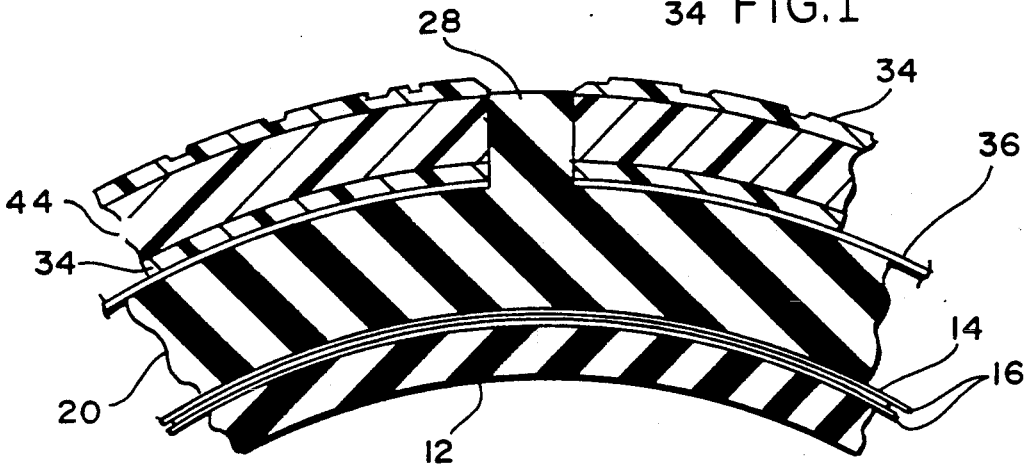
FIG. 2 is a cross-sectional view taken in the direction of arrows 2—2 of FIG. 1.
Figure 3:
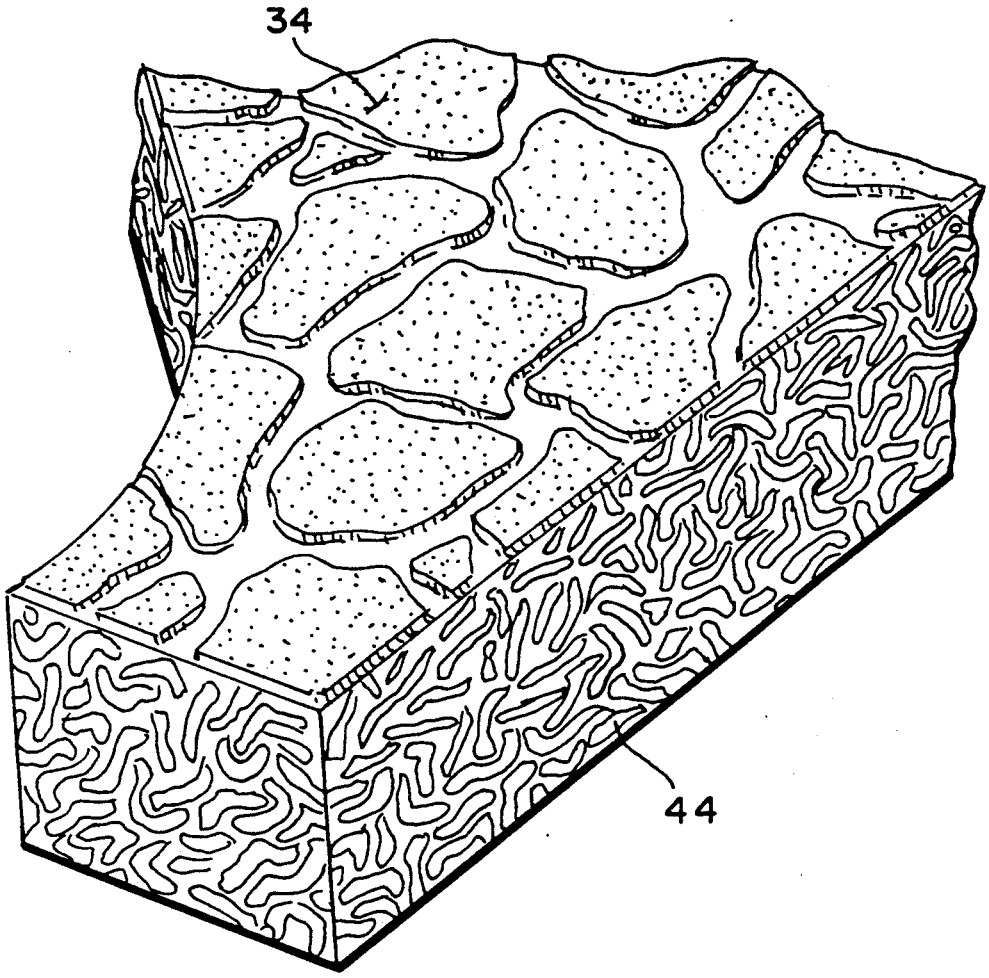
FIG. 3 is an enlarged end view of a portion of the insert material.

From an overview standpoint, a basketball 10 constructed in accordance with the principles of the present invention can readily be understood with reference to the showing of FIGS. 1, 2 and 3. Such basketball 10 is made up of four major components: (1) an interior balloon or bladder 12, (2) an intermediate layer 14 of monofilament strands 16 wrapped around the bladder, (3) a carcass 20 comprised of a pair of molded hemispheres 22, 24 secured over the intermediate layer 14 with exterior ribs or channels 28 defining spaces 30 between the channels and (4) insert panels 34 of polyurethane secured in the spaces 30 by an adhesive 36.

More specifically, the interior layer is formed spherically and is adapted to be filled with air to constitute a bladder 12 for the basketball 10. The interior bladder, when properly inflated with air, is adapted to provide the primary resilience to the finished basketball. The preferred material for the bladder is principally synthetic butyl rubber as is conventional for high quality basketballs but includes about 15% natural rubber with about 85% synthetic butyl rubber. The bladder has an exterior diameter of between about 230 and 240 millimeters, an interior diameter of between about 229 and 239 millimeters and a wall thickness of about 0.82 millimeters and weighs between about 140 and 150 grams. A conventional basketball has a wall thickness of about 0.85 millimeters and weighs between about 160 and 180 grams.

Next exterior to the interior layer or bladder 12 is an intermediate layer 14. The intermediate layer is formed of wound mcnofilament polymeric strands 16, preferably of Nylon 66 or Nylon/polyester mix. Each strand has a diameter of about 140 denur, 6.8 filaments. About 2,100 meters of such monofilament strands is wound around the bladder to form a thin layer, between about 2 to 4 strands in total thickness, or between about 0.3 to 0.7 millimeters. The strands are coated with an adhesive, preferably a solvent based rubber cement, to ensure retention of the strands on the bladder as is conventional. The exterior diameter of the wound bladder is thus between about 230.3 and 240.7 millimeters. The intermediate layer adds dimensional stability to the bladder and ball, restrains outward expansion when inflated and also reduces outward pressure on the exterior carcass.

The next exterior layer of the basketball is a molded rubber carcass 20. The carcass 20 is preferably formed of two hemispheres 22, 24 separated at equator line 26 which, when overlayed to cover the intermediate layer 14, will create the exterior of the ball. The exterior carcass has a thickness of about 1.8 to 2.0 millimeters over the majority of the surface, as is conventi: nal. The preferred material for the hemispheres is natural rubber. Molded into the hemispheres on the exterior surface thereof are exteriorly extending ribs or channels 28 in a pattern corresponding to the black lines normally visible when viewing a basketball. The ribs 28 extend outwardly from the central portion of the carcass 20 to a distance of about 1.8 millimeters or slightly less due to skiving of the panels. The approximate thickness of the insert panels 34 to be attached to the carcass is about 1.8 millimeters. As a result, the exterior diameter of the panels and, consequently, the finished ball is between about 9.46 and 9.55 inches, the regulation size for basketballs. This is a circumference of between about 29.5 and 30.0 inches. The molding of the carcass onto the intermediate layer forms the channels and causes the carcass material to flow into and around the strands of the intermediate layer for a secure mechanical bond.

The cover of the basketball is formed of panels 34. Such panels 34 are first cut to a shape to fit inside the spaces 30 between the ribs 28 as is conventional. An adhesive 36, preferably a contact cement such as styrene butadiene, holds the panels in place. Other suitable cements include ABS or a two part urethane. An aperture is formed in one panel and extends through the layers therebeneath for passage of a valve 40, formed integrally with the bladder, for inflating and deflating the basketball, also as is conventional.

As can be seen in FIG. 3, the polyurethane layer includes a plurality of monofilament polymeric fibers 44 of Nylon, a polyamide, or a polyester compressed together in an array to form a mat with polyurethane material located above, below, and throughout the spaces between the fibers. Such fibers have a diameter of about 1.0 micron. This is a size significantly smaller than the fibers used in prior applications to form synthetic panels. On the exterior surface of the panels, a grain-like pattern of raised portions in an irregular pebble-like pattern, is formed to simulate leather. The exterior surface is also then preferably painted to simulate grain leather.

The fabrication for the insert material includes an impregnation of fibers with polyurethane in dimethylformamide (DMF). The material subsequently undergoes an extraction process to give the material a soft feel. The top coat on the material is also a polyurethane, preferably the same material that is used to impregnate the fibers. Also, the diameter or denur (size) of the fibers is smaller than usual. More specifically, a solution of polyurethane elastomer in DMF, with sorbitan monostearate and stearyl alcohol as additives, is forced into the nonwoven fabric of the mat fibers and the solution impregnates down into the inside of the nonwoven fabric. In addition, a polyurethane solution with these additives in DMF is coated on top of the base material to form a polyurethane coating layer. Then, the base material with a polyurethane coating layer is put into an aqueous solution of DMF. This coagulates the solution of polyurethane elastomer and, during this wet coagulation process, the polyurethane elastomer changes the fibers into a microporous structure. In this coagulation process, these additives work as an accelerator to get more micropores and/or as a controller of the size of the pores.

The process for preparing the insert material, when considered in greater specificity, includes the preparation of the substrate which is prepared by providing a mat of fibers of Nylon or polyester, with a diameter of about 1 micron, to a thickness of between about 0.1 and 2.0 millimeters. Each fiber is coated with a starch. The next step is the impregnating of the fabric mat with a solution of polyurethane in DMF with the special additives described above. The additives represent a few percent by weight.

The same polyurethane with the special additives is put into the substrate mat layer to form a polyurethane coating layer on top of the mat. Then, the substrate with the polyurethane coating layer on its surface is immersed into an aqueous solution containing less than 50% of DMF for coagulation. In this wet coagulation process, the polyurethane impregnates into the nonwoven fabric which comes to have a microporous structure which can be expressed as a cellular plastic. Polyurethane in the substrate layer provides this very microporous cellular structure with the help of the special additives.

The sheet material formed by the above description process is dipped in toluene for a period of time sufficient to dissolve off one component in the fiber. At the same time, the special additives are extracted or removed out of the sheet material for softening of the material. A certain amount of starch deposited on the surface of nonwoven fabric has, at this time, already been removed out of the sheet materials during the process of coagulation. In order to obtain a sufficiently soft feel and texture, the polyurethane is coagulated unbonded to fibers with a microporous cellular structure in the substrate layer as if the fibers were floating.

The microporous cellular condition of polyurethane is not formed after the extraction of one component in the fiber. Such condition is formed earlier in the process of wet coagulation before the extraction process. The main purpose of the extraction process is to give the soft flexible texture to the sheet material as explained above.

The use of the polyurethane inserts has been found to provide characteristics to the basketball which are superior to the characteristics of any and all basketballs without high grade synthetic leather. Its characteristics are essentially the same as that of high grade leather for rebound characteristics, wear characteristics as well feel or handling properties. Such superior characteristics are attained with no change in manufacturing techniques but at a reduction in cost.

With specific reference to the characteristics of the new ball fabricated as described above, reference must be made to known balls. The construction for basketballs constructed in accordance with the principles of the present invention consists of the polyurethane material adhered to a carcass which meets the following specifications:

| | |
|---|---|
| Total Carcass Weight: | 465 to 475 grams |
| Bladder Composition: | 85% Butyl plus 15% Natural Rubber |
| Gage: | 0.80 mm |
| Weight: | 140 to 150 grams |
| Windings: | |
| Composition: | 60% Nylon 40% Polyester |
| Length: | 2100 Meters |
| Carcass Stock: | |
| Composition: | 65% Natural Rubber - 35% SBR |
| Gauge: | 1.8 to 2.0 mm |

This construction was derived by modifying the standard carcass construction for synthetic products so that when material panels are applied, the finished product would rebound comparable to a leather ball. This is achieved by balancing the carcass to provide enough resiliency such that when the panels are applied to the carcass, the ball would exhibit similar rebound characteristics to that of a ball using leather as a cover material.

A very important part of an inflated product is the bladder, which is responsible for holding air. Butyl, which has very good air retention characteristics, is the main ingredient in the bladder. Butyl rubber, however, does not have the resiliency characteristics of natural rubber and therefore adversely affect the rebound. With the subject basketball, the bladder was made lighter in weight to optimally minimize the effect butyl has on resiliency, and still maintain a high level of air retention.

Due to the fact that the total carcass weight is the sum of its components, the amount of natural rubber in the carcass stock could then be increased to balance the weight and also provide added resiliency. This differs from the construction of conventional leather balls in that the weight of the bladder in a conventional leather ball is a larger component of the total ball weight than that of the present invention.

Figure 4:
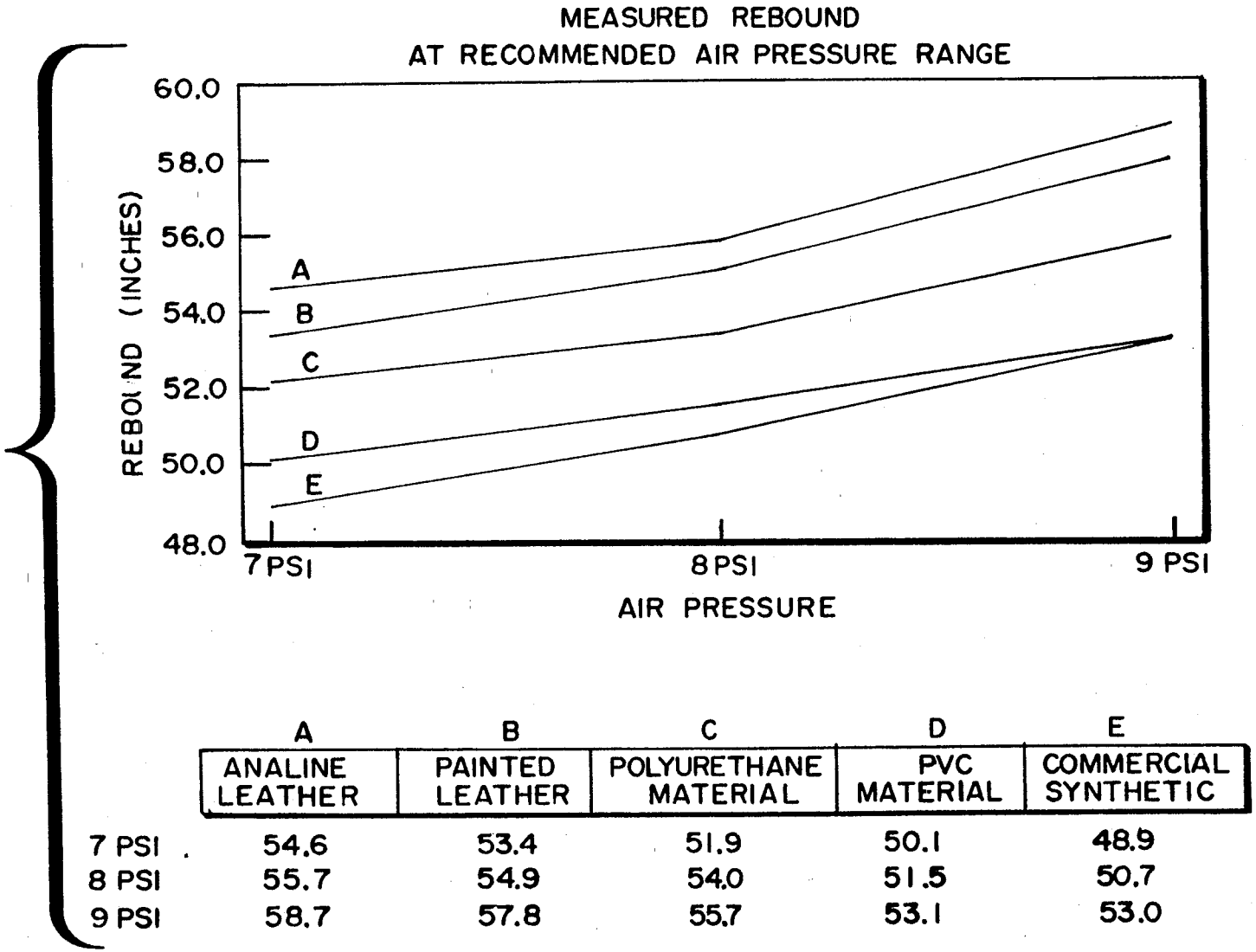
FIGS. 4–8 are various charts and graphs comparing and illustrating the properties of basketballs constructed in accordance with the principles of the present invention with those of the prior art.

The rebound measurements, note FIG. 4, are provided to show a comparison between the rebound characteristics of the subject basketball, line C, versus balls using leather (analine leather, line A, and painted leather, line B) and synthetic materials (polyvinyl chloride, PVC, line D and a commercial, line E). The balls being used for these measurements use different carcass constructions. It should be noted that the rebound numbers for the PVC basketball are markedly higher due to the fact that the carcass is constructed using only 1760 meters of windings as opposed to the 2100 meters in the present invention. The winding helps the ball to keep its shape after extended play but diminishes rebound characteristics. The present invention uses more winding because it is a higher profile product and durability or wear is one of its most important features.

Figure 5:
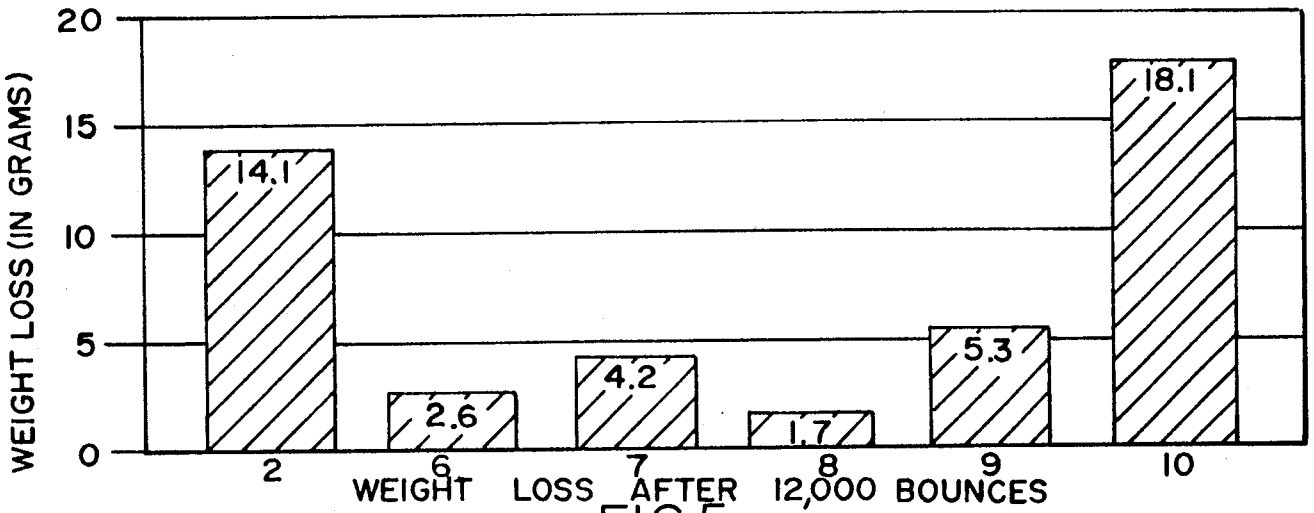
Figure 6:
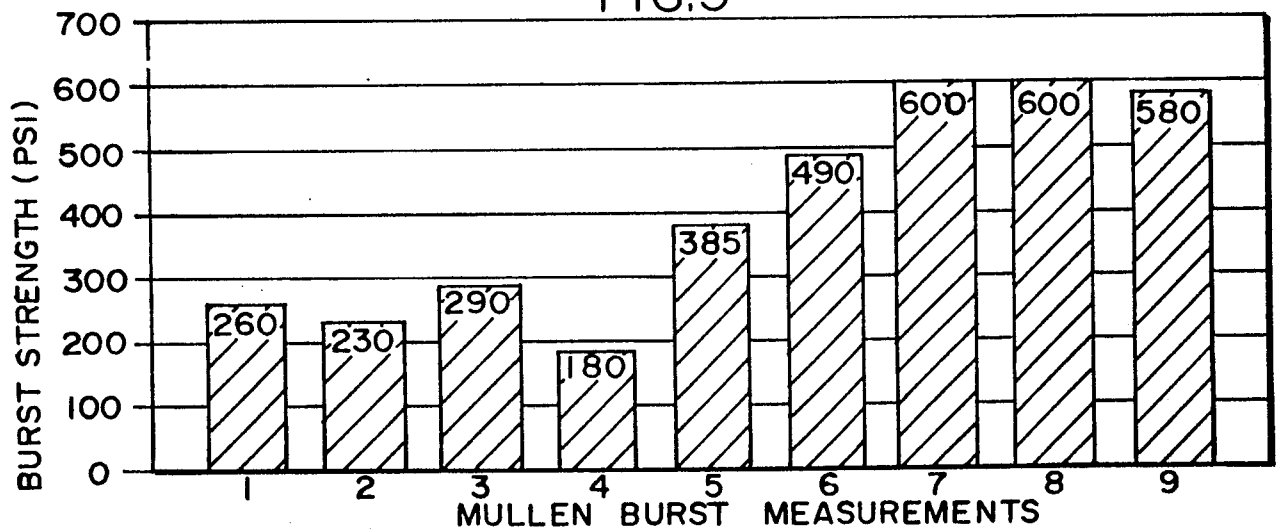
Figure 7:
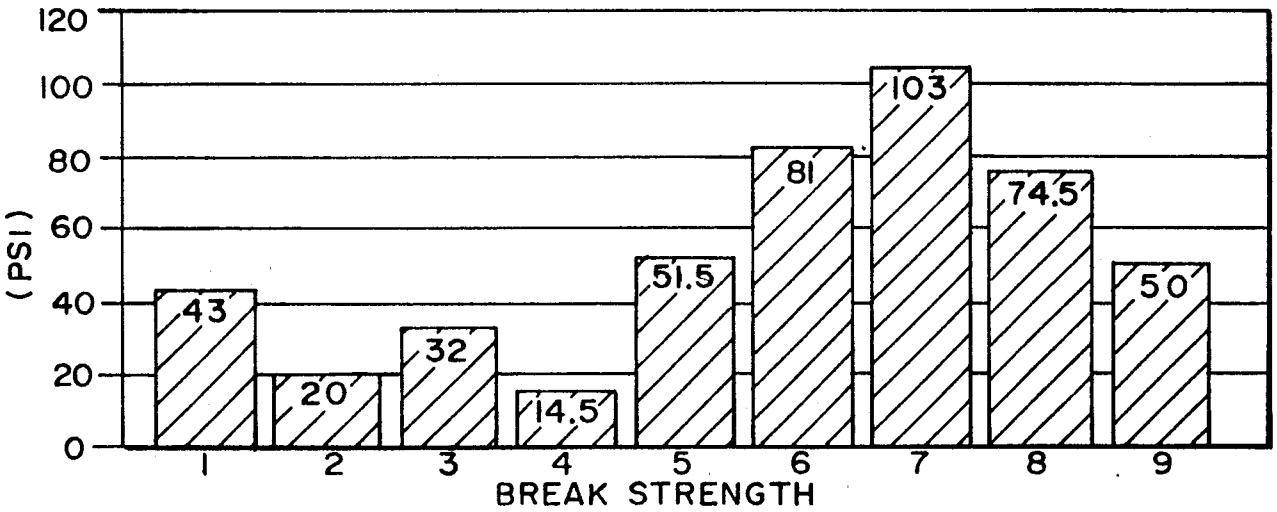
Figure 8:
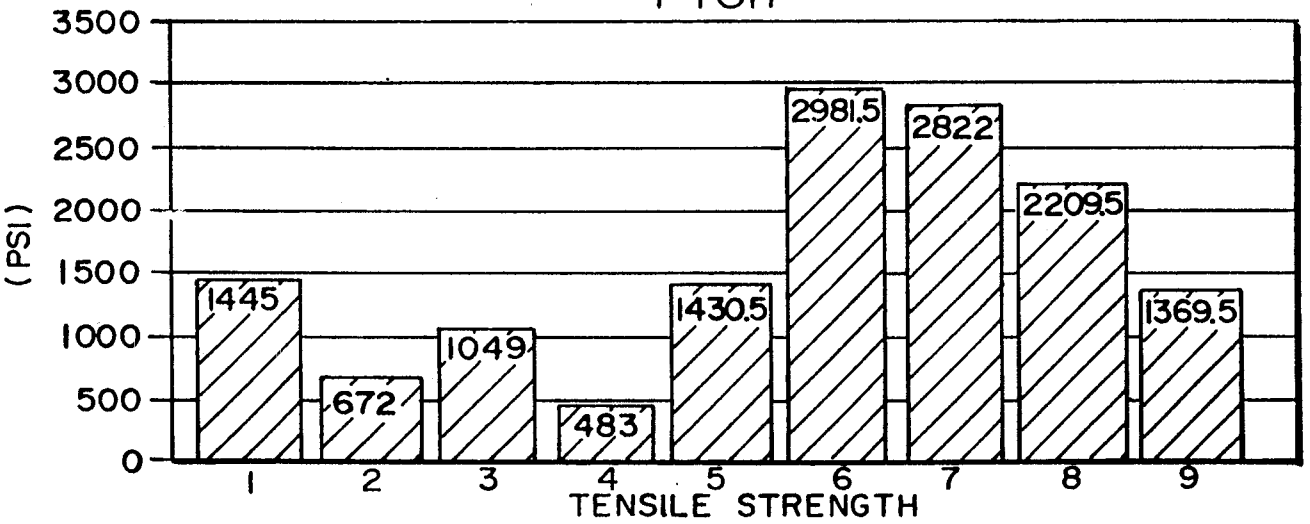

In order to quantify durability of the polyurethane material, tests were run on finished balls as well as the material itself. Six balls covered with various materials were run through the Spalding bounce tester for 12,000 bounces. The bounce tester is a machine that bounces the ball against a wooden surface for a specified number of bounces. This represents normal wear on the ball by simulating dribbling of the ball on a basketball court. Twelve thousand bounces would be the equivalent of one full basketball season. Weights were taken for each ball before and after the test and were recorded. Note FIG. 5. The weight loss of the synthetic material balls was significantly higher than that of the leather balls and also the balls covered with the polyurethane material. This demonstrates that the polyurethane material has durability characteristics similar to leather.

In FIGS. 5 through 8, basketballs of various materials were tested. Such materials are designated as follows:

1. A FIRST COMMERCIAL PVC
2. A SECOND COMMERCIAL PVC
3. A COMMERCIAL MEXICAN PVC
4. A COMMERCIAL FAR EAST PVC
5. CLARINO 2047
6. POLYURETHANE
7. PAINTED SPLIT LEATHER
8. ANALINE LEATHER
9. GXO LEATHER
10. PVC

Material tests were run on flat samples of various materials and the results recorded. The Mullen burst test measures the burst strength of the a material by placing a swatch of material in a "doughnut" shaped clamp and applying a force directly to the middle of the material. The measured number is the amount of force required to break the material. The test results show, in FIG. 6, that the polyurethane material has similar strength characteristics to leather. Tests were also run to determine tensile strength for each type of material. Tensile strength is determined by clamping a, strip of material by each end in an Instron machine which pulls the material. The amount of force required to break the material is recorded and placed in the following equation:

Break Force divided by the product of Thickness times Width.

This represents the Federal Method #2021 to measure how, "tough" a material is. The test results shows, in FIGS. 7 and 8, a distinct difference between the synthetic materials, leather and the polyurethane material.

From a subjective standpoint, the difference between polyurethane and the other synthetics is obvious to the touch. The ball produced with the polyurethane material has a distinctly softer initial feel which helps in controlling the ball in game situations. It differs from the synthetic materials in that synthetics generally have a harder, more plastic-like feel. After normal wear, the basketball of the present invention ball retains its soft feel and becomes more tacky because of the fibers of the backing becoming exposed. This quality is very similar to the wear characteristics of leather. Synthetics generally tend to lose pebbling and acquire a rubber-like feel after the pebbles have worn down.

The present disclosure includes that contained in the appended claims as well a that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. An improved basketball comprising:
   - an interior spherical bladder formed principally of synthetic butyl rubber with a thickness of about 0.82 millimeters;
   - an intermediate layer of monofilament strands formed of nylon and wound around the bladder to a thickness of between about 0.3 and 0.7 millimeters;
   - an exterior carcass of molded natural rubber formed of two hemispheres with exteriorly projecting ribs or channels, and
   - a plurality of polyurethane inserts formed with matted fibers of a polymeric material with a diameter of about 1 micron adhered to the exterior surface of the carcass between the ribs or channels, the inserts having a thickness of about 1.8 millimeters.

2. An improved basketball comprising an interior spherical bladder, an intermediate layer of monofilament strands wound around the bladder, an exterior carcass formed of two hemispheres with exteriorly projecting ribs or channels, and a plurality of synthetic inserts adhered to the exterior surface of the carcass between the ribs or channels, the inserts being fabricated of a mat of fibers and having a mat thickness of between about 0.1 and 2.0 millimeters, and polyurethane covering and encasing the mat to provide an insert thickness of between about 0.1 and 2.5 millimeters.

3. The basketball as set forth in claim 2 wherein the bladder is fabricated of about 85% synthetic butyl rubber and about 15% natural rubber.

4. The basketball as set forth in claim 3 wherein the weight of the bladder is between about 140 and 150 grams.

5. The basketball as set forth in claim 2 wherein the mat fibers are nylon.

6. The basketball as set forth in claim 2 wherein the mat fibers are a polyester.

7. The basketball as set forth in claim 2 wherein the fibers having a diameter of about 1 micron.

* * * * *